United States Patent [19]

Yokoya et al.

[11] Patent Number: 5,006,433

[45] Date of Patent: Apr. 9, 1991

[54] PRINTING PLATE PRECURSORS FOR ELECTROPHOTOGRAPHIC PLATE-MAKING PURPOSES

[75] Inventors: Hiroaki Yokoya; Hiromichi Tachikawa, both of Kanagawa, Japan

[73] Assignee: Fuji Photo Film Co., Ltd., Kanagawa, Japan

[21] Appl. No.: 370,973

[22] Filed: Jun. 26, 1989

[30] Foreign Application Priority Data

Jun. 27, 1988 [JP] Japan ..... 63-158365

[51] Int. Cl.[5] ..... G03G 13/28; G03G 5/00; G03C 1/725; G03C 1/73

[52] U.S. Cl. ..... 430/49; 430/96; 430/281

[58] Field of Search ..... 430/96, 49, 281

[56] References Cited

U.S. PATENT DOCUMENTS 3,533,787 10/1970 Merrill et al. ..... 430/96 X
3,953,309 4/1976 Gilano et al. ..... 430/281
4,175,964 11/1979 Uchida et al. ..... 430/253
4,294,905 10/1981 Okishi et al. ..... 430/175
4,822,705 4/1989 Fukagai et al. ..... 430/60

OTHER PUBLICATIONS

Anonymous, Photoconductive Elements Containing Polymeric Binders, Research Disclosure, Dec. 1973, pp. 130–133.

*Primary Examiner*—Marion E. McCamish
*Assistant Examiner*—S. Crossan
*Attorney, Agent, or Firm*—Sughrue, Mion, Zinn, Macpeak & Seas

[57] ABSTRACT

A printing plate precursor for electrophotographic printing plate making purposes wherein the binder resin used for a photoconductive layer comprises a copolymer of at least one vinyl ester compound or allyl ester compound having an aromatic ring as a monomer component and at least one vinyl polymerizable monomer containing at least one acidic functional group as a monomer component.

16 Claims, 2 Drawing Sheets

PRINTING PLATE PRECURSORS FOR ELECTROPHOTOGRAPHIC PLATE-MAKING PURPOSES

FIELD OF THE INVENTION

This invention concerns printing plate precursors for electrophotographic plate making purposes which have a photoconductive layer which contains an organic photoconductive compound and from which printing plates can be made by forming a toner image by means of an electrophotographic procedure and then removing the photoconductive layer in the non-image-forming parts other than the toner image parts and, more precisely, it concerns printing plate precursors for electrophotographic plate making purposes which have improved responsiveness to light and with which it is possible to shorten the plate making time by shortening the time elapsing from the completion of the exposure to the commencement of toner development.

BACKGROUND OF THE INVENTION

Today, PS (presensitized) plates in which positive type photosensitive agents of which the principal components are diazo compounds and phenolic resins, or negative type photosensitive agents of which the principal components are acrylic monomers or prepolymers thereof, are being used for lithographic offset printing plates, but these plates all have low sensitivity and plate making is carried out by attaching a pre-imagewise recorded film original and exposing the plate to light. On the other hand, as a result of the progress which has been made in recent years in computer graphics processing and large capacity data storage, and with data transmission techniques, electronic editing systems in which everything from original input through correction, editing and layout to page compilation is handled by computer and can be put immediately to terminal plotters in distant locations by means of a high speed communication networks or by satellite communication have been put into practical use. The need for electronic editing systems is especially great in the newspaper printing field where immediacy is essential. Furthermore, as a result of the development of ultralarge capacity memory devices, such as optical disks, for example, consideration has been given to the storage of originals as digital data on these recording media in fields where the original is stored as a master film and a plurality of printing plates are made, as required, on the basis of the stored original.

However, there are no really practical direct type printing plates from which a printing plate can be made directly from the output of a terminal plotter, and even when an electronic editing system has been used, the output is materialized using a silver salt photographic film in practice and the printing plate is produced indirectly on the basis of this film which is attached to a PS plate prior to exposure. One of the reasons for this is the difficulty involved in the production of direct type printing plates which have a sufficiently high speed to enable the printing plate to be made in a practical period of time using the light sources used in output plotters, such as He-Ne lasers and semiconductor lasers.

Electrophotographic photosensitive materials have been considered as photosensitive materials which are highly sensitive to light and which could provide direct type printing plates. Printing plate precursors for electrophotographic plate making purposes of the type with which the photoconductive layer in the nonimage parts is removed after forming a toner image are already well known. Thus, printing plate precursors for electrophotographic plate making purposes have been disclosed, for example, in JP-B-37-17162, JP-B-38-6961, JP-B-38-7758, JP-B-41-2426, JP-B-46-39405, JP-A-50-19509, JP-A-50-19510, JP-A-52-2437, JP-A-54-145538, JP-A-54-134632, JP-A-55-105254, JP-A-55-153948, JP-A-55-161250, JP-A-57-147656 and JP-A-57-161863 (the terms "JP-A" and "JP-B" as used herein refers to "published unexamined Japanese patent application" and "examined Japanese patent publication", respectively).

It is usually necessary to remove the nonimage parts with an alkaline etchant to expose a hydrophilic surface if an electrophotographic photosensitive material is to be used as a printing plate, and so resins which dissolve or swell in alkaline solvents and are stripped away are often used as binder resins. In general, resins which dissolve or swell in alkaline solvents have poor compatibility with organic photoconductive compounds when compared to the polycarbonate resins which are widely used as binder resins for electrophotographic materials and, consequently, the amount of organic photoconductive compound which can be introduced into the electrophotographic photosensitive layer is limited. Even if sufficient carriers for eliminating the surface potential are formed in the photoconductive layer, if the organic photoconductive compound content in the photoconductive layer is low then the rate of migration of the carriers in the photoconductive layer is reduced and the rate at which the surface potential falls is low, which is to say the response rate is low, since it is the organic photoconductive compound which has the function of transporting the carriers in the photoconductive layer. Consequently, the time elapsing from the completion of exposure before the surface potential has been reduced sufficiently so that fogging does not occur and toner development can commence is prolonged. Consideration has been given to increasing the exposure brightness and shortening the exposure time in order to shorten the overall process from surface charging to development as much as possible, but the response time is long even when the exposure time is reduced with the result that there is little shortening of the overall processing time. Hence, the slowness of the response rate greatly impedes any shortening of the overall processing time. Furthermore, other problems arise in cases where a scanning exposure is carried out using a high brightness light source, such as a laser light source, for example. Thus, if the response rate is low, the rate of reduction of the surface potential differs in the parts where write-in starts and finishes. That is to say, there is no fogging in the parts where write-in starts but fogged images are formed where write-in finishes and errors inevitably occur when a printing plate is made. Known binder resins which have been used in the past in printing plate precursors for electrophotographic plate making purposes include styrene/maleic anhydride copolymers, vinyl acetate/crotonic acid copolymers, vinyl acetate/maleic anhydride copolymers, phenolic resins, and copolymers of acrylic acid ester monomers or methacrylic acid ester monomers and monomers which contain a carboxylic acid group, as disclosed, for example, in JP-B-41-2426, JP-B-37-17162, JP-B-38-6961, JP-A-52-2437, JP-A-54-19803, JP-A-54-134632, JP-A-55-105254, JP-A-50-19509, JP-A-50-19510, JP-A-57-161863 and JP-A-58-76843. However, various problems are known to arise when these are used in printing plate precursors for electrophotographic plate making purposes in which organic photoconductive compounds are used. Thus, the film forming properties are poor and cracking occurs, and the adhesion of the film is poor and unable to withstand the printing of large numbers of copies. Furthermore, when these binders are used the response rate is generally slow and the problems which have appeared in recent years resulting from this have still to be resolved.

SUMMARY OF THE INVENTION

The first object of this present invention is to provide printing plate precursors for electrophotographic plate making purposes which have good sensitivity and a rapid response rate.

The second object of the invention is to provide printing plate precursors for electrophotographic plate making purposes which are suitable for image formation using a scanning exposure with a laser, for example.

The third object of the invention is to provide printing plate precursors for electrophotographic plate making purposes which have excellent printing durability.

Thus, as a result of thorough research by the inventors, the above-mentioned objects have been realized by means of printing plate precursors for electrophotographic printing plate making purposes comprising at least a photoconductive layer which contains an organic photoconductive compound and a binder resin on a support, wherein the printing plates are made by imagewise exposure, forming a toner image, and then removing the photoconductive layer in the non-image-forming parts other than the toner image parts, and wherein the aforementioned binder resin for the photoconductive layer is a copolymer comprising at least one vinyl ester compound or allyl ester compound, each containing an aromatic ring as a monomer component and at least one vinyl polymerizable monomer containing at least one acidic functional group as a monomer component.

Figure 1:
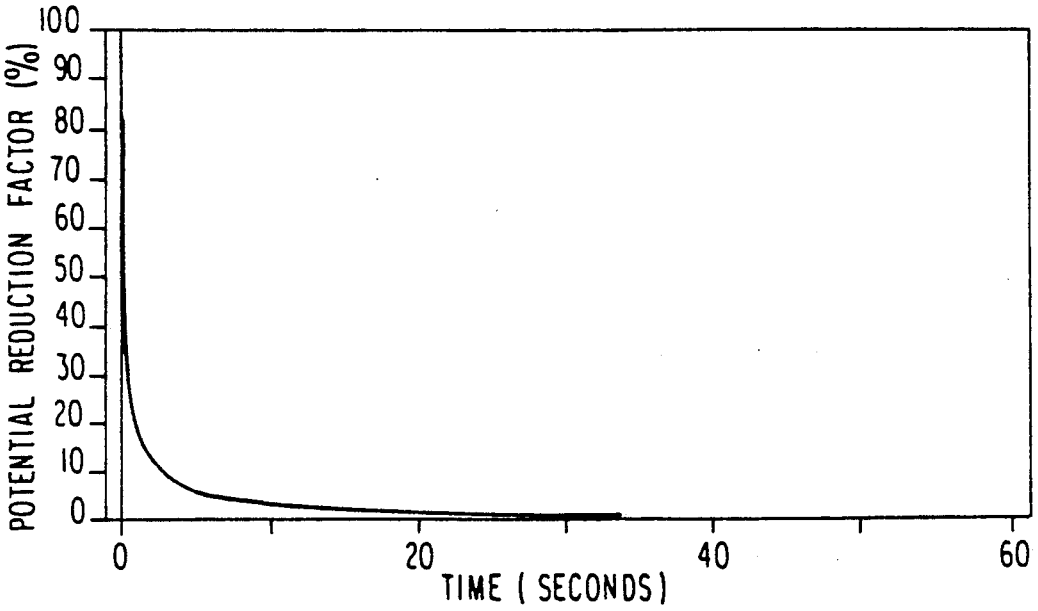
FIGS. 1 to 5 are graphs depicting the changes in the reduction factor of the surface potentials in Example 1 and Comparative Examples 1 to 4, respectively.

The reduction factor is expressed on the basis of a value of 100% immediately after exposure and a value of 0% 60 seconds after exposure.

DETAILED DESCRIPTION OF THE INVENTION

The acid residue of the vinyl ester compound or allyl ester compound having an aromatic ring may be an aromatic hydrocarbon-based acid, such as benzoic acid, o-methylbenzoic acid, p-methylbenzoic acid, m-methylbenzoic acid, p-ethylbenzoic acid, p-tert-butylbenzoic acid, chlorobenzoic acid, phenylacetic acid, o-tolylacetic acid, m-tolylacetic acid, p-tolylacetic acid, p-ethylphenylacetic acid, phenylpropionic acid, p-tolylpropionic acid, $\alpha$-naphthylacetic acid or $\beta$-naphthylacetic acid, or an aromatic heterocyclic-based acid having an aromatic heterocyclic group, for example, furan, thiophene, pyrrole, pyran, thiopyran, thiazole, imidazole, pyrimidine, triazine, indole, quinoline or purine, such as 2-pyrimidinoacetic acid, 4-pyridinoacetic acid, imidazol-ylacetic acid, 4-indolylacetic acid, pyrimidinoacetic acid or thiazolylacetic acid. The aromatic groups (which include aromatic heterocyclic groups) in this invention may contain from 1 to 3 substituent groups, such as hydrogen atoms, alkyl groups, allyl groups, aryl groups, aralkyl groups, alkoxy groups, aryloxy groups, alkoxycarbonyl groups, halogen atoms, nitro groups, amido groups, cyano groups, carbonyl groups, trifluoromethyl groups, amino groups and dialkylamino groups. The preferred substituent groups are hydrogen atoms, alkyl groups which have from 1 to 5 carbon atoms, allyl groups which have from 3 to 5 carbon atoms, aryl groups which have from 6 to 10 carbon atoms, aralkyl groups which have from 7 to 10 carbon atoms, alkoxy groups which have from 1 to 5 carbon atoms, aryloxy groups which have from 6 to 10 carbon atoms, alkoxycarbonyl groups which have from 2 to 5 carbon atoms, halogen atoms, amino groups, nitro groups, cyano groups, trifluoromethyl groups, alkoxy groups, amido groups and amino groups substituted with alkyl groups which have from 1 to 5 carbon atoms. The aromatic ring in the vinyl ester compounds is preferably an aromatic hydrocarbon ring, and substituted or unsubstituted vinylbenzoate or vinylphenylacetate are especially desirable as vinyl ester compounds which have aromatic rings.

The acidic functional group of the vinyl polymerizable monomer which has an acidic functional group in this invention may be a carboxyl group, an acid anhydride group, a hydroxyl group, a phenolic hydroxyl group, a sulfonic acid group, a sulfonamido group or a sulfonimido group. Actual examples of vinyl polymerizable monomers which have acidic functional groups include acrylic acid, methacrylic acid, crotonic acid, maleic acid, phthalic acid, maleic anhydride, p-carboxystyrene, p-hydroxystyrene, p-hydroxyphenylacrylamide, hydroxyethyl methacrylate, hydroxyethylmethacrylamide and p-vinylbenzenesulfonic acid. Crotonic acid, acrylic acid and methacrylic acid are preferred as the vinyl polymerizable monomer which has an acidic functional group.

The copolymerization ratio of the allyl ester or vinyl ester compound which has an aromatic ring and the vinyl polymerizable monomer which has an acidic functional group in the binder resins of this invention varies according to the types of monomers which are being used and the type of liquid (etchant) which is used to remove the photoconductive layer, but the vinyl polymerizable monomer with an acidic functional group preferably accounts for from 5 to 60 mol% of all the monomer components. In cases where, from the point of view of pollution, an alkaline solution which has an alkaline hydroxide as its principal component is used as the etchant, a vinyl polymerizable monomer which has acidic functional group content preferably accounts for from 15 to 60 mol% of all the monomer components. On the other hand, the amount of the allyl ester or vinyl ester compound having an aromatic ring preferably accounts for from 40 to 95 mol%, and more preferably from 40 to 85 mol%, of all the monomer components.

Furthermore, other vinyl polymerizable monomers may be included as third components in the binder resins of this invention. Examples of such vinyl polymerizable monomers include vinyl ester compounds which do not have an aromatic group such as vinyl acetate, styrene and styrene derivatives such as vinyl toluene, t-butylstyrene and chlorostyrene, substituted or unsubstituted alkyl esters of acrylic acid or methacrylic acid, substituted or unsubstituted alkyl amides of acrylic acid or methacrylic acid, acrylonitrile, vinylidene chloride and vinyl chloride.

When a third copolymer component is used it can be used to replace part of the vinyl ester or allyl ester compound which has an aromatic group, and the amount used is preferably within the range of up to 30 mol% of the whole copolymer.

Actual examples of the binder resins in this invention are listed below.

(1) Vinyl benzoate/crotonic acid (90/10)
(2) Vinyl benzoate/crotonic acid (80/20)
(3) Vinyl benzoate/crotonic acid (70/30)
(4) Vinyl benzoate/crotonic acid (60/40)
(5) Vinyl benzoate/crotonic acid (50/50)
(6) Vinyl phenylacetate/crotonic acid (70/30)
(7) Vinyl α-naphthylacetate/crotonic acid (70/30)
(8) Vinyl p-methylbenzoate/crotonic acid (65/35)
(9) Vinyl benzoate/crotonic acid/acrylic acid (70/20/10)
(10) Vinyl p-ethylbenzoate/crotonic acid (75/25)
(11) Vinyl p-tert-butylbenzoate/crotonic acid (70/30)
(12) Vinyl benzoate/vinyl acetate/crotonic acid (50/20/30)
(13) Vinyl 2-pyridinomethylacetate/crotonic acid (70/30)
(14) Vinyl p-tert-butylbenzoate/vinyl acetate/crotonic acid (60/10/30)
(15) Vinyl p-n-propylbenzoate/crotonic acid/methacrylic acid (65/25/10)
(16) Allyl benzoate/crotonic acid (80/20)
(17) Allyl p-methylbenzoate/crotonic acid (65/35)
(18) Allyl benzoate/crotonic acid/acrylic acid (70/20/10)
(19) Allyl p-tert-butylbenzoate/vinyl acetate/crotonic acid (60/10/30)

The numerical values in brackets indicate the copolymer ratios in mols.

These binder resin can be prepared easily using the generally known methods of polymerization. The molecular weight of the binder resin is satisfactory for use within the range from 1,000 to 500,000, but a molecular weight within the range from 8,000 to 150,000 is preferred from the viewpoint of the strength of the film which is formed and the rate of removal of the photoconductive layer.

The printing plate precursors for electrophotographic plate making purposes in which an organic photoconductive compound is used and with which the nonimage parts of the photoconductive layer are removed after forming a toner image can be classified into two types as indicated below. Those of the first type have a photoconductive layer of which the principal components are organic photoconductive compounds, sensitizing dyes and binder resins, as disclosed, for example, in JP-B-37-17162, JP-B-62-51462, JP-A-52-2437, JP-A-54-19803, JP-A-56-107246 and JP-A-57-161863, and those of the second type have a photoconductive layer of which the principal components are a charge generating agent, a charge transporting agent and a binder resin, as disclosed, for example, in JP-A-56-146145, JP-A-60-17751, JP-A-60-17752, JP-A-60-17760, JP-A-60-254142 and JP-A-62-54266. Photoconductive layers which have a double layer structure in which a charge generating agent and a charge transporting agent are included in separate layers as disclosed, for example, in JP-A-60-230147, JP-A-60-230148 and JP-A-60-238853, are also known as examples of a special case of the second type. The printing plate precursors for electrophotographic plate making purposes of this invention may be embodiments of either of the two types of photoconductive layer described above. In cases of the second type, the organic photoconductive compounds referred to in this invention function as charge transporting agents.

The following compounds are included among the organic photoconductive compounds which can be used in this invention:

(a) Triazole derivatives as disclosed, for example, in U.S. Patent No. 3,112,197.
(b) Oxadiazole derivatives as disclosed, for example, in U.S. Patent No. 3,189,447.
(c) Imidazole derivatives as disclosed, for example, in JP-B-37-16096.
(d) Polyarylalkane derivatives as disclosed, for example, in U.S. Pat. Nos. 3,615,402, 3,820,989 and 3,542,544, JP-B-45-555, JP-B-51-10983, JP-A-51-93224, JP-A-55-108667, JP-A-55-156953 and JP-A-56-36656.
(e) Pyrazoline derivatives and pyrazolone derivatives as disclosed, for example, in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637 and JP-A-55-74546.
(f) Phenylenediamine derivatives as disclosed, for example, in U.S. Pat. No. 3,615,404, JP-B-51-10105, JP-B-46-3712, JP-B-47-28336, JP-A-54-83435, JP-A-54-110836 and JP-A-54-119925.
(g) Arylamine derivatives as disclosed, for example, in U.S. Pat. Nos. 3,567,450, 3,180,703, 3,240,597, 3,658,520, 4,232,103, 4,175,961 and 4,012,376, West German Patent (DAS) 1,110,518, JP-B-49-35702, JP-B-39-27577, JP-A-55-144250, JP-A-56-119132 and JP-A-56-22437.
(h) Amino substituted chalcone derivatives as disclosed in U.S. Pat. No. 3,526,501.
(i) N,N-Bicarbazyl derivatives as disclosed, for example, in U.S. Pat. No. 3,542,546.
(j) Oxazole derivatives as disclosed, for example, in U.S. Pat. No. 3,257,303.
(k) Styrylanthracene derivatives as disclosed, for example, in JP-A-56-46234.
(l) Fluorenone derivatives as disclosed, for example, in JP-A-54-110837.
(m) Hydrazone derivatives as disclosed, for example, in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144.
(n) Benzidine derivatives as disclosed, for example, in U.S. Pat. Nos. 4,047,948, 4,047,949, 4,265,990, 4,273,846, 4,299,897 and 4,306,008.
(o) Stilbene derivatives as disclosed, for example, in JP-A-58-190953, JP-A-59-95540, JP-A-59-97148, JP-A-59-195658 and JP-A-62-36674.
(p) Polyvinylcarbazoles and derivatives thereof as disclosed in JP-B-34-10966.
(q) The vinyl polymers, such as polyvinylpyrene, polyvinylanthracene, poly[2-vinyl-4-(4'-dimethylaminophenyl)-5-phenyloxazole] and poly(3-vinyl-N-ethylcarbazole), as disclosed in JP-B-43-18674 and JP-B-43-19192.
(r) Phthalocyanine compounds, such as the nonmetal or metal phthalocyanine as disclosed, for example, in U.S. Pat. Nos. 3,397,086, 3,357,989 and 4,666,802, JP-A-51-90827, JP-A-51-23738, JP-A-52-55643, JP-A-60-243089 and JP-A-61-115085.

(s) The polymers, such as the polyacenaphthylene, polyindene and acenaphthylene/styrene copolymers, as disclosed in JP-B-43-19193.

(t) The condensed resins, such as pyrene/formaldehyde resins, bromopyrene/formaldehyde resins and ethylcarbazole/formaldehyde resins, disclosed, for example, in JP-B-56-13940.

(u) The various triphenylmethane polymers, etc., as disclosed in JP-A-56-90883 and JP-A-56-161550.

Moreover, the organic photoconductive compounds are not limited to those described under (a) to (u) above, and any of the already known organic photoconductive compounds can be used in this invention. Depending on the particular case, two or more of these organic photoconductive compounds can be used in combination.

The known sensitizing dyes used in the past in electrophotographic photosensitive materials can be used as the sensitizing dyes which are included in photoconductive layers of the first type. These have been described, for example, in *Electrophotography,* 12, 9 (1973) and *Organic Synthetic Chemistry,* 24, (11), 1010, (1966). For example, use can be made of the pyryliumtype dyes disclosed, for example, in U.S. Pat. Nos. 3,141,770 and 4,283,475, JP-B-48-25658 and JP-A-62-71965, the triarylmethane-type dyes disclosed, for example, in *Applied Optics Supplement,* 3, 50 (1969) and JP-A-50-39548, the cyanine dyes disclosed, for example, in U.S. Pat. No. 3,597,196 and the styryl-type dyes disclosed, for example, in JP-A-60-163047, JP-A-59-164588 and JP-A-60-252517.

The various organic and inorganic charge generating agents known in the past in connection with electrophotographic photosensitive materials can be used as the charge generating agents which are used in photosensitive layers of the second type. For example, use can be made of selenium, selenium/tellurium, cadmium sulfide, zinc oxide and the organic pigments indicated under (1) to (9) below.

(1) Azo pigments, such as the monoazo, bisazo and trisazo pigments disclosed, for example, in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941 and JP-B-60-45664.

(2) Phthalocyanine pigments such as the nonmetal or metal phthalocyanines disclosed, for example, in U.S. Pat. Nos. 3,397,086 and 4,666,802, JP-A-51-90827 and JP-A-52-55643.

(3) Perylene-type pigments as disclosed, for example, in U.S. Pat. No. 3,371,884 and JP-A-47-30330.

(4) Indigo and thioindigo derivatives as disclosed, for example, in British Patent 2,237,680 and JP-A-47-30331.

(5) Quinacridone-type pigments as disclosed, for example, in British Patent 2,237,679 and JP-A-49-30332.

(6) Polycyclic quinone-type pigments as disclosed, for example, in British Patent 2,237,678, JP-A-59-184348, JP-A-62-28738 and JP-A-47-18544.

(7) Bisbenzimidazole-type pigments as disclosed, for example, in JP-A-47-30331 and JP-A-47-18543.

(8) Squalium salt-type pigments as disclosed, for example, in U.S. Pat. Nos. 4,396,610 and 4,644,082.

(9) Azulenium salt-type pigments as disclosed, for example, in JP-A-59-53850 and JP-A-61-212542.

These may be used individually or two or more types can be used in combination. When these charge generating agents also have a charge transporting function, it is not always necessary to use other charge transporting agents in this invention.

The various known additives which have been used in the past in electrophotographic photosensitive materials can be included in the photosensitive layers of the printing plate precursors for electrophotographic plate making purposes of this invention. These additives include chemical sensitizers for improving electrophotographic sensitivity and various plasticizers and surfactants, etc., for improving film properties. Examples of chemical sensitizers include electron attracting compounds such as p-benzoquinone, chloranil, fluoranil, bromanil, dinitrobenzene, anthraquinone, 2,5-dichlorobenzoquinone, nitrophenol, tetrachlorophthalic acid anhydride, 2,3-dichloro-5,6-dicyanobenzoquinone, dinitrofluorenone, trinitrofluorenone and tetracyanoethylene, and the compounds disclosed, for example, in JP-A-58-65439, JP-A-58-102239, JP-A-58-129439 and JP-A-62-71965.

Plasticizers, such as dimethyl phthalate, dibutyl phthalate, dioctyl phthalate, triphenyl phosphate, diisobutyl adipate, dimethyl sebacate, dibutyl sebacate, butyl laurate, methyl phthalyl ethyl glycolate and dimethylglycol phthalate, can be added to improve the flexibility of the photoconductive layer. These plasticizers can be included in amounts within the range where they do not cause any deterioration in the electrostatic characteristics or etching properties of the photoconductive layer.

The mixing ratio of the organic photoconductive compounds and binder resins in this invention is such that the upper limit for the organic photoconductive compound is set by the compatibility of the organic photoconductive compound with the binder resin. If an amount in excess of this limit is added then crystallization of the organic photoconductive compounds occurs and this is undesirable. The electrophotographic sensitivity falls as the organic photoconductive compound content is reduced and so the amount included is preferably as large as possible within the range where crystallization of the organic photoconductive material does not occur. The rate at which the organic photoconductive compound is included is from 5 to 120 parts by weight, and preferably from 10 to 100 parts by weight, per 100 parts by weight of binder resin. Furthermore, the organic photoconductive compounds can be used individually, or two or more types can be used in combination.

Furthermore, a mixture of two or more types of resin can be used for the binder resin. In cases where a mixture of two or more binder resins is used, provided that at least one of these resins is a resin of this invention the other resins in the mixture may be any of those known in the past, as described earlier.

Furthermore, if the photoconductive layer in this invention is too thin it is not possible to charge the layer to the surface potential required for development, while if it is too thick, when etching is in the direction parallel to the surface, an effect known as side etching occurs when the photoconductive layer is being removed and it is impossible to obtain good printing plates. The thickness of the photoconductive layer is from 0.1 to 30 $\mu$m, and preferably from 0.5 to 10 $\mu$m.

Electrically conductive supports which have a hydrophilic surface, for example, plastic sheets which have an electrically conductive surface or, in particular, papers which have been rendered impermeable to solvents and electrically conductive metal sheets such as aluminum sheets, zinc sheets, or bimetal sheets such as copper/aluminum sheets, copper-stainless steel sheets, and chromium/copper sheets, or trimetal sheets such as chromium/copper/aluminum sheets, chromium/lead/iron sheets and chromium/copper/stainless steel sheets, can be used as the electrically conductive supports which are used in the present invention. These supports preferably have a thickness of from 0.1 to 3 mm and, most desirably, they have a thickness of from 0.1 to 0.5 mm. The aluminum sheets used in the invention are sheets of pure aluminum, or aluminum alloys of unspecified composition which contain trace quantities of other atoms and of which the principal component is aluminum, and the materials commonly used in the past can be used for this purpose.

The aluminum sheets may be sanded and anodized for use using the conventional methods. Prior to the sanding treatment, the sheet may be degreased using a surfactant or an aqueous alkali solution, as required, in order to remove the rolling grease from the surface of the aluminum sheet, and the sanding treatment is carried out after such a treatment. The sanding may be achieved using a method in which the surface is roughened mechanically, a method in which the surface is dissolved electrochemically, or a method in which the surface is selectively dissolved chemically. Any of the known methods, such as ball polishing methods, brush polishing methods, blast polishing methods and buff polishing methods, can be used as methods by which the surface is roughened mechanically. Furthermore, methods in which either an alternating current or a direct current is applied in a hydrochloric acid or nitric acid electrolyte can be used for roughening the surface electrochemically. Furthermore, use can also be made of methods like that disclosed in JP-A-54-63902 where both these methods are combined.

Aluminum sheets of which the surface has been roughened can be subjected to an alkali etching treatment and neutralizing treatment, as required.

The aluminum sheets which have been treated as above are subjected to an anodizing treatment. Sulfuric acid, phosphoric acid, oxalic acid, chromic acid or mixtures of these acids can be used as the electrolyte for the anodizing treatment. The electrolyte used and its concentration can be set appropriately according to the type of electrolyte. The anodizing conditions can be varied according to the electrolyte which is being used and so no specifications are laid down in this connection but, in general terms, the electrolyte concentration is such as to provide a solution containing from 1 to 80 wt% of the electrolyte, the solution temperature is set between 5° and 70° C., the current density is set between 5 and 60 A/dm$^2$, the voltage is set between 1 and 100 V, and the electrolysis time is selected appropriately in the range from 10 seconds to 50 minutes. The weight of anodically oxidized film is suitably within the range from 0.1 to 10 g/m$^2$, and preferably within the range from 1 to 6 g/m$^2$.

Moreover, the use of aluminum sheets which have been treated by immersion in an aqueous solution of an alkali metal silicate after the anodizing treatment, as disclosed in JP-B-47-5125, is preferred. Furthermore, silicate electrodeposition as disclosed in U.S. Pat. No. 3,658,662 is also effective. The treatment with poly(vinylsulfonic acid) disclosed in West German Patent Laid Open No. 1,621,478 is also appropriate.

Furthermore, alkali-soluble intermediate layers consisting of casein, poly(vinyl alcohol), ethyl cellulose, phenolic resin, styrene/maleic anhydride copolymers or poly(acrylic acid), for example, may be established, as required, between the electrically conductive support and the photoconductive layer in this invention in order to improve adhesion or to improve the electrostatic characteristics of the printing plate precursor for electrophotographic plate making purposes.

Furthermore, overcoating layers which can be removed at the same time as the photoconductive layer is being removed can be established, as required, over the photoconductive layer, with a view to improving the electrostatic characteristics, the development characteristics during toner development, or the image characteristics or printing characteristics, etc. This overcoating layer may be a layer which has been matted mechanically, or it may consist of a resin layer which contains a matting agent. In this case, silicon dioxide, glass particles, alumina, starch, titanium oxide or zinc oxide particles, or particles of a polymer, such as poly(methyl methacrylate), polystyrene, or a phenolic resin, for example, or the matting agents described in the specifications of U.S. Pat. Nos. 2,701,245 and 2,992,101, can be included as a matting agent. Two or more of these matting agents can be used in combination. The resin used to form the overcoating layer is selected appropriately in accordance with the composition of the etchant with which the photoconductive layer is to be removed. In practice, gum arabic, glue, cellulose, starch, poly(vinyl alcohol), poly(ethylene oxide), poly(acrylic acid), polyacrylamide, poly(vinyl methyl ether), epoxy resin, phenolic resin, polyamide or poly(vinyl butyral), for example, can be used for the resin. Two or more of these resins can be used in combination.

Any of the toners used as electrophotographic toners in dry type developers or wet type developers, which are resistant to the etchant used to remove the nonimage parts, and which have the function of preventing the dissolution of the photoconductive layer in the toner image parts in the etchant, can be used as the toner which is used in the invention, but the use of liquid developers is preferred for obtaining high resolution images. Moreover, those which are hydrophobic and which provide an inkable toner image are preferred. For example, polymeric substances, such as polystyrene-type resins, polyester-type resins, homopolymers and copolymers of acrylic esters, homopolymers and copolymers of methacrylic esters, ethylene copolymers, cyclized rubbers, homopolymers or copolymers of vinyl acetate, and vinyl chloride can be used as toner particle components. Furthermore, colorants such as carbon black and nigrosin-type pigments, and pigments and dyes such as phthalocyanine blue, phthalocyanine green, benzidine yellow, alkali blue and carmine 6B, can be included within such a range that there is no adverse effect on the fixing properties, dispersion properties or etching resistance of the toner. Moreover, various charge controlling agents and other additives can also be included.

Any solvent capable of removing the photoconductive insulating layer can be used as the etchant for removing the non-toner image parts of the photoconductive insulating layer after the toner image has been formed, and no particular limitation is imposed thereon. However, the use of alkaline solutions is preferred. These may be aqueous solutions which contain an alkaline compound, or organic solvents which contain an alkaline compound, or mixtures of organic solvents and aqueous solutions which contain an alkaline compound.

Any organic or inorganic alkaline compound, for example, sodium hydroxide, potassium hydroxide, sodium carbonate, sodium silicate, potassium silicate, sodium metasilicate, potassium metasilicate, sodium phosphate, potassium phosphate or ammonia, or an amino alcohol such as monoethanolamine, diethanolamine or triethanolamine, can be used as the alkaline compound.

As mentioned earlier, water and many organic solvents can be used as the solvent for the etchant, but the use of etchants which are mainly water based are preferred from the point of view of both odor and pollution. Various organic solvents can be added, as required, to etchants which are mainly water based. Preferred organic solvents include lower alcohols and aromatic alcohols, such as methanol, ethanol, propanol, butanol, benzyl alcohol and phenethyl alcohol, and ethylene glycol, diethylene glycol, triethylene glycol, polyethylene glycol, cellosolves, and amino alcohols such as monoethanolamine, diethanolamine and triethanolamine. Furthermore, surfactants, anti-foaming agents and other additives can be included, as required, in the etchants which are used in the invention.

The method by which a printing plate is made from a printing plate precursor for electrophotographic plate making purposes of this invention is described below. Thus, an image is formed on the printing plate precursor for electrophotographic plate making purposes of this invention by means of a conventional electrophotographic process. That is to say, the plate is charged uniformly in the dark and an electrical latent image is formed by imagewise exposure. The exposure can be made as a reflected imagewise exposure or as a contact exposure through a transparent positive image film, using a xenon lamp, tungsten lamp or fluorescent lamp as a light source, or by means of a scanning exposure using laser light or light emitting diodes. In the case of a scanning exposure, the exposure can be made with a laser light source, using a helium/neon laser, a helium/cadmium laser, an argon ion laser, a krypton ion laser, a YAG laser, a ruby laser, a nitrogen laser, a dye laser, an excimer laser or a semiconductor laser, such as a GaAs/GaAlAs or an InGaAsP laser, or an alexandrite laser, a copper vapor laser or an erbium laser, or it can be made using light emitting diodes or a liquid crystal shutter (including a line printer type light source using a light emitting diode array or a liquid crystal shutter array).

Dry developing methods (cascade development, magnetic brush development, powder cloud development) or liquid development methods can be used for developing the above-mentioned electrostatic latent image with the toner. Of these possible methods, the liquid development methods are able to form finely detailed images and they are preferred for forming printing plates. Moreover, positive-positive development with positive development, or negative-positive development with reversal development can be achieved with the imposition of the appropriate bias voltage. The toner image which is formed can be fixed using the known methods, for example, by thermal fixing, pressure fixing or solvent fixing. The toner image formed in this way functions as a resist and the printing plate can be formed by removing the nonimage parts of the photoconductive layer by means of an etchant.

The invention is described in practical terms below by means of examples, but it is not limited by these examples. Moreover, the term "parts" as used in the examples signifies in all cases "parts by weight".

EXAMPLE 1

Trisazo compound (indicated below) as a charge generating agent — 0.68 part

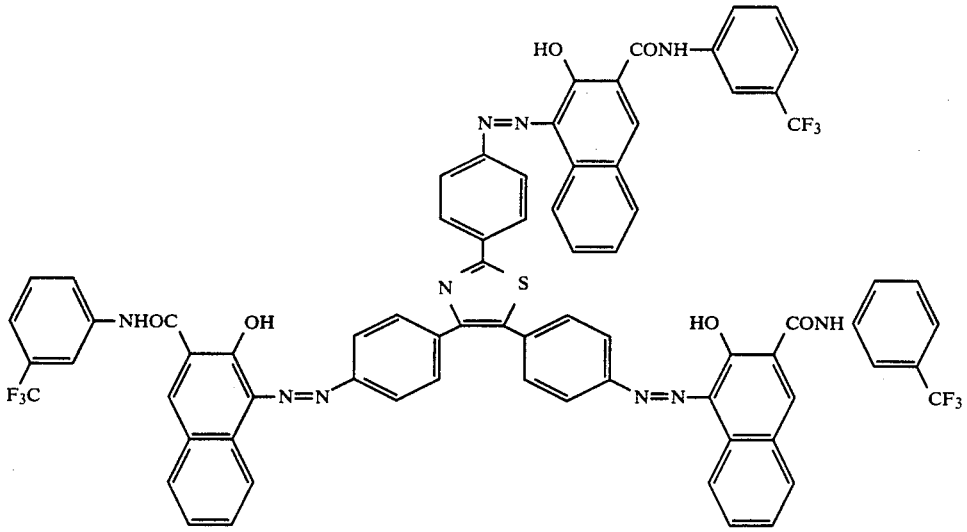

Hydrazone compound (indicated below) as an organic photoconductive compound — 1.6 parts -continued

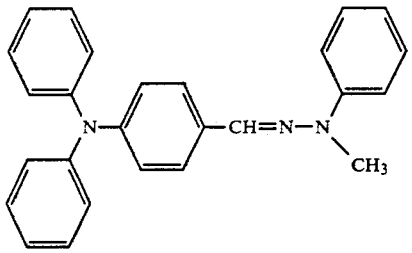

| | |
|---|---|
| Copolymer (3) of this invention | 9.0 parts |
| Tetrahydrofuran | 100 parts |

A liquid dispersion for forming a photoconductive layer was prepared by introducing the components indicated above, along with some glass beads, into a glass reactor of capacity 500 ml, dispersing for 60 minutes in a paint shaker (made by Toyo Seiki Seisakujo), and subsequently removing the glass beads by filtration.

This liquid dispersion was coated onto an aluminum sheet of thickness 0.25 mm which had been sanded and dried to provide a printing plate precursor for electrophotographic plate making purposes which had a photoconductive layer of dry film thickness 5.1 μm.

Next, the response rate of the printing plate precursor for electrophotographic plate making purposes prepared in this way was measured. Thus, the printing plate was charged in the dark to a surface potential of +400 V using a corona discharge machine, after which it was exposed to light at a rate of 26 erg/cm$^2$ using a flash lamp which provided a light emission of 35 μ.seconds duration and the fall in the surface potential which occurred with the passage of time was measured. The way in which the surface potential fell with respect to time from the surface potential immediately after exposure to the surface potential observed 60 seconds after exposure was as shown in FIG. 1. The value immediately after exposure is taken to be 100% and the value after 60 seconds is taken to be 0%. The time required for the surface potential to fall to one tenth (to 10%) of the initial value was 2.3 seconds.

Next, the printing plate precursor for electrophotographic plate making purposes so obtained was charged with a corona discharge at +7.5 kV with a static system using an electrostatic copying paper testing machine EPA-8100 (made by Kawaguchi Denki Co.) and exposed using a halogen lamp, and the electrophotographic characteristics were investigated.

The surface potential immediately after charging (V0) and the exposures required to provide a light reduction of the surface potential before exposure to one half (E50) and to one fifth (E80) obtained were as follows:

V0 +445 V
E50 3.1 lux.sec
E80 8.7 lux.sec

Next, the sample was charged in the dark to a surface potential of +450 V and exposed in such a way as to provide a scanning exposure at the plate surface of 30 erg/cm$^2$ with light of wavelength 633 nm using an He/Ne laser. The exposed plate was developed using a liquid developer, prepared by dispersing 5 g of poly(methyl methacrylate) grains (particle size: 0.3 μm) as toner particles in 1 liter of "Isopar H" (Esso Standard Co.) and adding 0.01 g of soybean lecithin as a charge controlling agent, with the application of a bias voltage of 30 V to a counter electrode, and a distinct positive toner image was obtained in this way. An image with no fogging in either the write-in start parts or the write-in end parts was obtained.

Moreover, the toner was fixed by heating to 100° C. for 30 seconds. The nonimage parts of this printing plate precursor for electrophotographic plate making purposes were removed with a liquid etchant obtained by diluting 40 parts of potassium silicate, 10 parts of potassium hydroxide, and 100 parts of ethanol with 800 parts of water, after which the plate was thoroughly rinsed with water and an offset printing plate was obtained on coating with gum.

On printing in the usual way with the printing plate so obtained using a "Hamada Star 600 CD" offset printing press it was possible to obtain 50,000 very distinctly printed copies with no staining in the nonimage parts.

COMPARATIVE EXAMPLE 1

A printing plate precursor for electrophotographic plate making purposes was prepared in just the same way as in Example 1 except that Copolymer (A) indicated below was used as the binder resin in place of Copolymer (3) of this invention.

COPOLYMER (A)

Vinyl acetate/crotonic acid copolymer
("Resyn-28-1310" made by the Kanebo NSC Co.)

Figure 2:
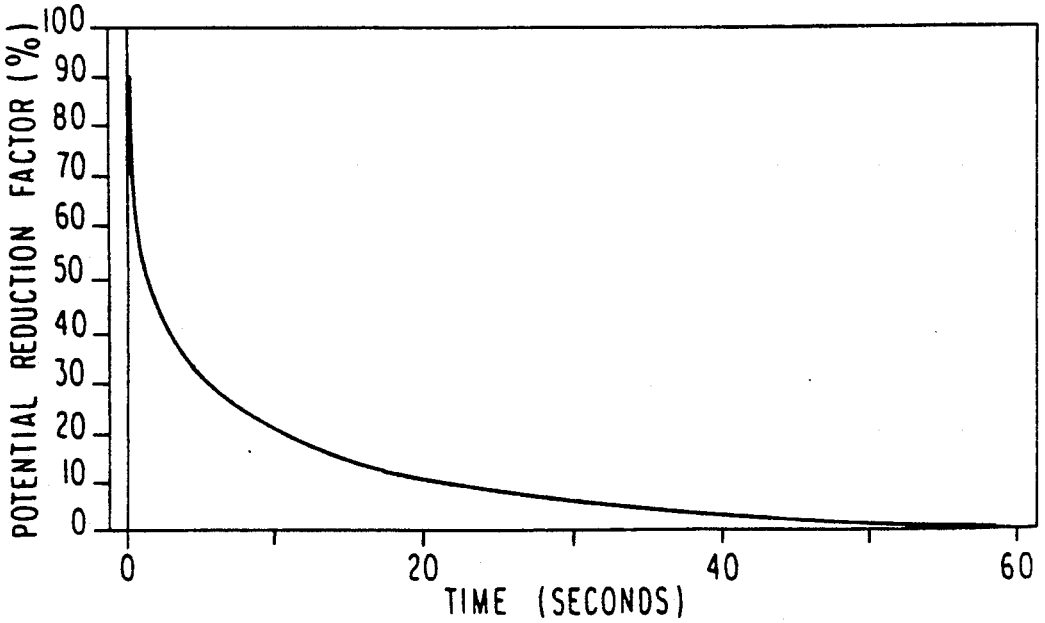

The response rate of the printing plate precursor for electrophotographic plate making purposes so obtained was measured in the same way as in Example 1 and the results are shown in FIG. 2. The time required for the surface potential to fall to one tenth (to 10%) of the initial value was 20 seconds.

This sample was charged in the dark to a surface potential of +450 V and then exposed using an He/Ne laser to light of wavelength 633 nm in such a way that the exposure at the plate surface was 30 erg/cm$^2$, after which it was developed in the same way, and using the same liquid developer, as in Example 1. The image obtained, however, was not even, and although there was no fogging in the parts where image write-in started, fogging had occurred in the parts where write-in finished.

Moreover, the toner image was fixed by heating to 100° C. for 30 seconds. The nonimage parts of this printing plate precursor for electrophotographic plate making were removed with a liquid etchant obtained by diluting 40 parts of potassium silicate, 10 parts of potassium hydroxide, and 100 parts of ethanol with 800 parts of water, after which the plate was thoroughly rinsed with water, and an offset printing plate was obtained on coating with gum. When this printing plate was used in a "Hamada Star 600 CD" offset printing press, base staining occurred on the prints as a result of printing ink adhering to the parts where fog was retained and it was not possible to obtain distinct printed material.

In order to obtain an even image with no fogging in the write-in finish part it was necessary to provide a waiting time of some 30 to 60 seconds from the end of write-in before starting toner development.

COMPARATIVE EXAMPLE 2

A printing plate precursor for electrophotographic plate making purposes was prepared in the same way as in Example 1 except that Copolymer (B) indicated below was used as the binder resin in place of Copolymer (3) of this invention.

COPOLYMER (B)

Styrene/maleic anhydride copolymer (maleic anhydride content: 50 mol%)

Figure 3:
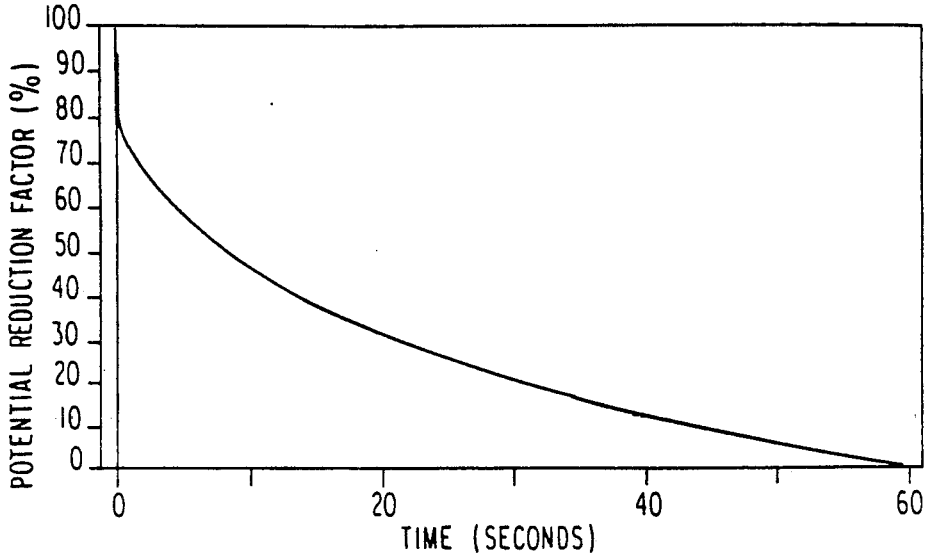

The response rate of the printing plate precursor for electrophotographic plate making purposes so obtained was measured in the same way as in Example 1 and the results are shown in FIG. 3. The time required for the surface potential to fall to one tenth (to 10%) of the initial value was 43 seconds.

COMPARATIVE EXAMPLE 3

A printing plate precursor for electrophotographic plate making purposes was prepared in the same way as in Example 1 except that Copolymer (C) indicated below was used as the binder resin in place of Copolymer (3) of this invention.

COPOLYMER (C)

Isobutyl methacrylate/methacrylic acid (60/40 by mol)

Figure 4:
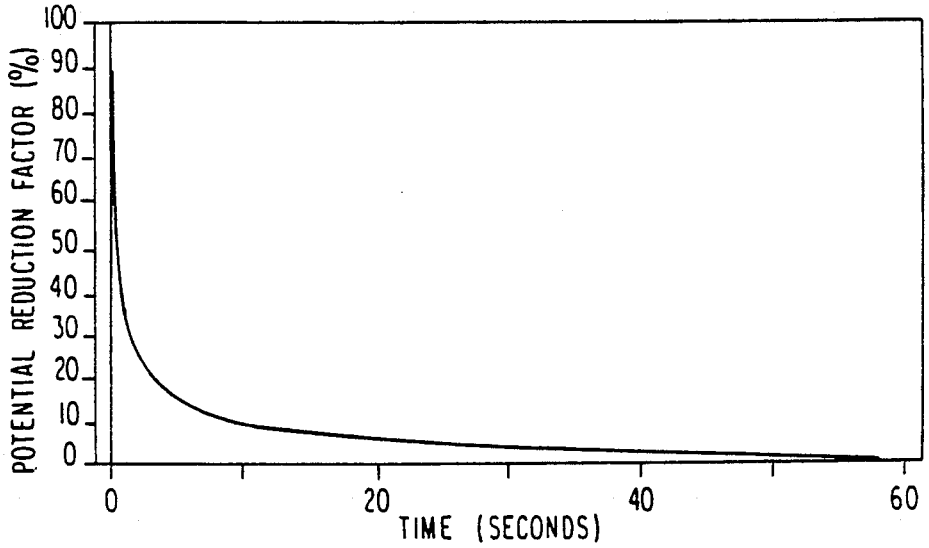

The response rate of the printing plate precursor for electrophotographic plate making so obtained was measured in the same way as in Example 1 and the results are shown in FIG. 4. The time required for the surface potential to fall to one tenth (to 10%) of the initial value was 10 seconds.

COMPARATIVE EXAMPLE 4

A printing plate precursor for electrophotographic plate making purposes was prepared in the same way as in Example 1 except that Copolymer (D) indicated below was used as the binder resin in place of Copolymer (3) of this invention.

COPOLYMER (D)

Methyl methacrylate/methacrylic acid (80/20 by mol)

Figure 5:
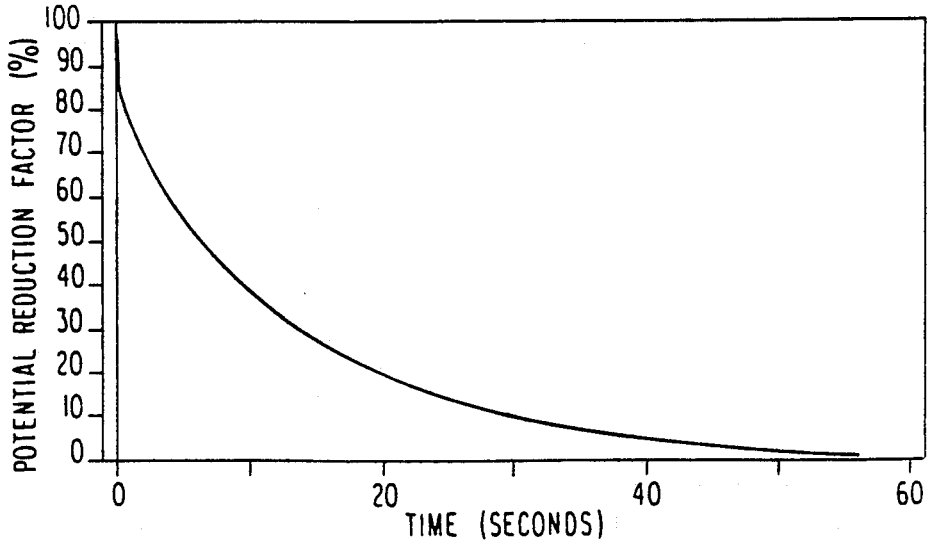

The response rate of the printing plate precursor for electrophotographic plate making purposes so obtained was measured in the same way as in Example 1 and the results are shown in FIG. 5. The time required for the surface potential to fall to one tenth (to 10%) of the initial value was 30 seconds.

EXAMPLES 2 TO 11

Printing plate precursors for electrophotographic plate making purposes were prepared in the same way as in Example 1 except that Copolymers (1), (2), (4), (5), (6), (7), (11), (12), (13) and (14) of this invention were used in place of Copolymer (3) of this invention.

The response rates of the printing plate precursors for electrophotographic plate making purposes so obtained were measured in the same way as in Example 1, and the time required for the surface potential to fall to one tenth (to 10%) of the initial value were obtained. The results obtained are shown in Table 1.

TABLE 1

| Example No. | Copolymer | Response Time (10%) (seconds) |
|---|---|---|
| Example 2 | (1) | 1.3 |
| Example 3 | (2) | 1.7 |
| Example 4 | (4) | 2.5 |
| Example 5 | (5) | 4.5 |
| Example 6 | (6) | 2.4 |
| Example 7 | (7) | 2.6 |
| Example 8 | (11) | 2.4 |
| Example 9 | (12) | 3.6 |
| Example 10 | (13) | 3.1 |
| Example 11 | (14) | 3.2 |

EXAMPLE 12

A printing plate precursor for electrophotographic plate making purposes was prepared in the same way as in Example 1 except that the oxadiazole compound indicated below was used as the organic photoconductive compound in place of the hydrazone compound.

The response rate of the printing plate precursor for electrophotographic plate making purposes so obtained was measured in the same way as in Example 1 and the time required for the surface potential to fall to one tenth (to 10%) of the initial value was 2.7 seconds.

Oxadiazole Compound

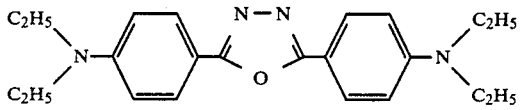

EXAMPLE 13

Hydrazone compound (indicated below) as an organic photoconductive compound — 25 parts

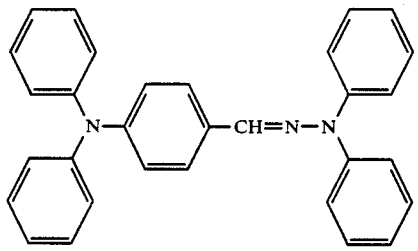

Copolymer (2) as a binder resin — 75 parts

Thiopyrylium salt compound (indicated below) as a sensitizing dye — 1.18 parts

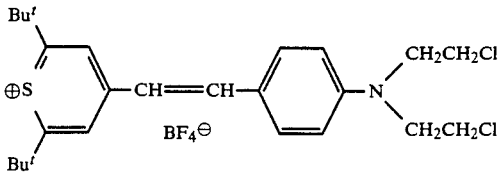

(Bu^t represents a tert-butyl group)

The components indicated above were dissolved in a mixed solvent comprising 510 parts of methylene chloride and 150 parts of methyl cellosolve acetate.

This solution was coated onto a sanded aluminum sheet of thickness 0.25 mm and dried to provide a printing plate precursor for electrophotographic plate making purposes which had a photoconductive layer of dry film thickness 5.4 μm.

Next, the sample was charged in the dark to a surface potential of +450 V and exposed to light of wavelength 633 nm using an He/Ne laser. The exposed plate was developed using a liquid developer, prepared by dispersing 5 g of poly(methyl methacrylate) grains (particle size: 0.3 μm) as toner particles in 1 liter of "Isopar H" (Esso Standard Co.) and adding 0.01 g of soybean lecithin as a charge controlling agent, and a distinct positive toner image with no fogging in either the write-in start parts or the write-in finish parts was obtained.

Moreover, the toner was fixed by heating to 100° C. for 30 seconds. The photosensitive layer in the nonimage parts of this printing plate precursor for electrophotographic plate making purposes where no toner was attached was removed completely by immersion for about 1 minute in a liquid etchant obtained by dissolving 70 g of hydrated sodium metasilicate in 140 ml of glycerin, 550 ml of ethylene glycol and 150 ml of ethanol, and then rinsing the plate while brushing lightly.

On printing in the usual way with the printing plate so obtained using a "Hamada Star 600 CD" offset printing press it was possible to obtain 50,000 very distinctly printed copies with no staining in the nonimage parts.

The printing plate precursors for electrophotographic plate making purposes of this invention are excellent plates which have an improved response rate, and a shortening of the process time of the plate making operation has been realized in this way. Furthermore, the problem of the occurrence of fogging which arise because of the rise in the residual potential in the parts where write-in finishes due to the slow response rate with direct type printing plates with which a scanning exposure system with a laser, for example, is being used can be overcome with printing plate precursors for electrophotographic plate making purposes of this invention, and good printing plates with no fogging in the write-in start and finish parts can be obtained.

While the invention has been described in detail and with reference to specific embodiments thereof, it will be apparent to one skilled in the art that various changes and modifications can be made therein without departing from the spirit and scope thereof.

What is claimed is:

1. A printing plate precursor for electrophotographic printing plate making purposes in which the printing plate is made by imagewise exposure, forming a toner image, and then removing a photoconductive layer in the non-image-forming parts other than the toner image parts, said printing plate precursor comprising at least a photoconductive layer which comprises an organic photoconductive compound and a binder resin on a support wherein the binder resin for the photoconductive layer is a copolymer comprising at least one vinyl ester compound or allyl ester compound, each of which has an aromatic ring, as a monomer component, and at least one vinyl polymerizable monomer which has at least one acidic functional group as a component monomer.

2. The printing plate precursor as claimed in claim 1, wherein the acid residue of the vinyl ester compound or allyl ester compound having an aromatic ring is an aromatic hydrocarbon based acid or an aromatic heterocyclic based acid.

3. The printing plate precursor as claimed in claim 2, wherein the acid residue of the vinyl ester compound or allyl ester compound having an aromatic ring is an aromatic hydrocarbon based acid.

4. The printing plate precursor as claimed in claim 3, wherein the vinyl ester compound is a substituted or unsubstituted vinylbenzoate or vinylphenylacetate.

5. The printing plate precursor as claimed in claim 2, wherein the aromatic hydrocarbon based acid is selected from the group consisting of benzoic acid, o-methylbenzoic acid, p-methylbenzoic acid, m-methylbenzoic acid, p-ethylbenzoic acid, p-tert-butylbenzoic acid, chlorobenzoic acid, phenylacetic acid, o-tolylacetic acid, m-tolylacetic acid, p-tolylacetic acid, p-ethylphenylacetic acid, phenylpropionic acid, p-tolylpropionic acid, α-naphthylacetic acid or β-naphthylacetic acid.

6. The printing plate precursor as claimed in claim 2, wherein the aromatic heterocyclic group of the aromatic heterocyclic based acid is furan, thiophene, pyrole, pyran, thiopyran, thiazole, imidazole, pyrimidine, triazine, indole, quinoline or purine.

7. The printing plate precursor as claimed in claim 1, wherein the acidic functional group of the vinyl polymerizable monomer having at least one acidic functional group is a carboxyl group, an acid anhydride group, a hydroxyl group, a phenolic hydroxyl group, a sulfonic acid group, a sulfonamido group or a sulfonimido group.

8. The printing plate precursor as claimed in claim 7, wherein the vinyl polymerizable monomer having at least one acidic functional group is acrylic acid, methacrylic acid, crotonic acid, maleic acid, phthalic acid, maleic anhydride, p-carboxystyrene, p-hydroxystyrene, p-hydroxyphenylacrylamide, or p-vinylbenzenesulfonic acid.

9. The printing plate precursor as claimed in claim 7, wherein the vinyl polymerizable monomer having an acidic functional group is crotonic acid, acrylic acid or methacrylic acid.

10. The printing plate precursor as claimed in claim 1, wherein the binder contains 5 to 60 mol% of the vinyl polymerizable monomer containing at least one acidic functional group.

11. The printing plate precursor as claimed in claim 10, wherein the binder contains 15 to 60 mol% of the vinyl polymerizable monomer containing at least one acidic functional group.

12. The printing plate precursor as claimed in claim 1, wherein the binder contains up to 30 mol% of a third different copolymer component.

13. The printing plate precursor as claimed in claim 1, wherein the binder resin has a molecular weight of from 1,000 to 500,000.

14. The printing plate precursor as claimed in claim 1, wherein the photoconductive layer contains a charge generating agent which is selenium, selenium/ tellurium, cadmium sulfide, zinc oxide or an organic pigment selected from the group consisting of azo pigments, phthalocyanine pigments, perylene pigments, indigo and thioindigo derivatives, quinacridone-type pigments, polycyclic quinone-type pigments, bisbenzimidazole-type pigments, squalium salt-type pigments and azulenium salt-type pigments.

15. The printing plate precursor as claimed in claim 1, wherein the organic photoconductive compound is present in from 5 to 120 parts by weight per 100 parts by weight of binder resin.

16. The printing plate precursor as claimed in claim 1, wherein the photoconductive layer is from 0.1 to 30 μm in thickness.

* * * * *